US011609071B1

(12) United States Patent
Pegouske et al.

(10) Patent No.: US 11,609,071 B1
(45) Date of Patent: Mar. 21, 2023

(54) BELOW/ABOVE-WATER REMOTE ENERGETIC ATTACHMENT KINETIC KILL ROD(BREAKKR) PROJECTILE

(71) Applicant: The United States of America as Represented by the Secretary of the Navy, Indian Head, MD (US)

(72) Inventors: Adam Pegouske, White Plains, MD (US); Lee Foltz, Indian Head, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/300,508

(22) Filed: Jul. 28, 2021

(51) Int. Cl.
*F42B 12/06* (2006.01)
*F42D 5/04* (2006.01)

(52) U.S. Cl.
CPC ..... *F42B 12/06* (2013.01); *F42D 5/04* (2013.01)

(58) Field of Classification Search
CPC ..... F42B 12/06; F42D 5/04
USPC ..... 86/50
See application file for complete search history.

(56) References Cited

U.S. PATENT DOCUMENTS

| | | | | |
|---|---|---|---|---|
| 4,770,102 | A | 9/1988 | Bisping et al. | |
| 6,173,922 | B1 | 1/2001 | Hoyt et al. | |
| 6,439,127 | B1 | 8/2002 | Cherry | |
| 8,646,388 | B1 | 2/2014 | Bradbury | |
| 9,021,958 | B1 | 5/2015 | Bradbury | |
| 9,347,728 | B1 * | 5/2016 | Richwald | F41A 23/02 |
| 10,066,916 | B1 * | 9/2018 | Vabnick | F42B 12/82 |
| 2008/0121097 | A1 * | 5/2008 | Rudakevych | F41H 7/005 901/1 |
| 2014/0063679 | A1 * | 3/2014 | Park | F41H 13/0025 361/232 |
| 2017/0122035 | A1 | 5/2017 | Baym et al. | |
| 2021/0362815 | A1 * | 11/2021 | Wistedt | F42D 5/04 |
| 2022/0136814 | A1 * | 5/2022 | Austin | B23D 53/001 86/50 |

FOREIGN PATENT DOCUMENTS

| | | |
|---|---|---|
| GB | 2483861 | 3/2012 |

* cited by examiner

*Primary Examiner* — Samir Abdosh
(74) *Attorney, Agent, or Firm* — Fredric J. Zimmerman

(57) ABSTRACT

A disruptor projectile includes a shaft made up of an elongate rod. A head piece assembly is connected to an end of the elongate rod. A post is located inside the head piece assembly. A tether line having an end with an eye splice attached around the post. The length of the tether line extends parallel to the elongate rod.

21 Claims, 5 Drawing Sheets

BELOW/ABOVE-WATER REMOTE ENERGETIC ATTACHMENT KINETIC KILL ROD(BREAKKR) PROJECTILE

ORIGIN OF THE INVENTION

The invention described herein was made in the performance of official duties by employees of the U.S. Department of the Navy and may be manufactured, used, or licensed by or for the Government of the United States for any governmental purpose without payment of any royalties thereon.

BACKGROUND

Field of the Invention

The present invention relates to equipment for use in explosive ordnance disposal (EOD) and in particular to kinetic kill rod projectiles for EOD disruptors.

Description of the Background

In the art of hazardous devices access and disablement, including explosive ordnance disposal, a common tool, particularly for neutralizing improvised explosive devices (IEDs), is a disruptor. For explosive ordnance disposal, in addition to rendering the device safe, it is often necessary to remove the target. Some known IED threats and newly emerging IED threats use metal-cased devices. Existing projectiles fired from EOD disruptors exist, which may be used against buried or submerged targets. Such projectiles can perforate a target and allow a pull line inside the IED threat. However, against metal barriers, the pull line can break off the projectile during impact as the line is usually connected to the side of the projectile. Furthermore, the size and strength of the line is generally insufficient to remove the target because they do not exceed the strength of the target components during a pull.

There remains a need for a kinetic kill rod projectile with a strong tether in which the projectile perforates an energetic threat when fired from an EOD disruptor, breaks components in the energetic threat, and allows a robust pull line to be secured inside the threat to enable the threat to be pulled or secured. There remains a need for a tether line attached to the projectile in which the line allows the pull strength to exceed the strength of the structural components of the targets.

SUMMARY

The Below/Above-water Remote Energetic Attachment Kinetic Kill Rod (BREAKKR) projectile disclosed herein has a rod body and a head on the front of the projectile. A robust tether line is attached to a tight-eye connection on the front head of the projectile. The line is protected during impact with an energetic threat due to the line running parallel to the rod body. The tether line has sufficient strength to create forces exceeding 30,000 lbs. once the projectile is attached into the target. The head of the projectile is modular to allow different shaped heads to be used. In use, the rod is muzzle-loaded into an EOD disruptor with a blank cartridge that is used to propel the projectile out of the barrel. The projectile perforates the target and the line follows through the perforate hole. Once the entire projectile is inside the target, the projectile turns and does not allow removal from the perforation hole.

It is an object of the present invention to provide a kinetic kill rod projectile for use in EOD operations that may be fired from EOD disruptors using blank cartridges. It is a further object of the present invention that the kinetic kill rod projectile perforates a target and embeds a line inside the target. It is a further object of the present invention that a large line may be used on the projectile to perforate target without breaking line. It is another object of the present invention that line strength be greater than approximately 30,000 lbs in order to be greater than the structural strength of the target.

It is another object of the present invention to provide a modular head assembly that allows different head designs to be bolted onto the front of the rod body. The blunt face of the head allows impact into curved, round, and/or angled surfaces while the shape of the enclosure protects the line during impact. Due to the position of where the line is attached to the projectile, the line will not shear or break during impact.

According to an aspect of the invention, a disruptor projectile includes a shaft made up of an elongate rod. A head piece assembly is connected to an end of the elongate rod. A post is located inside the head piece assembly. A tether line having an end with an eye splice is attached around the post. The length of the tether line extends parallel to the elongate rod.

According to an exemplary penetrator projectile for use in a disruptor, a head piece assembly has a head distal end and a head proximal end and a shaft has a shaft distal end and a shaft proximal end. The shaft distal end is connected to the head proximal end. A tether line has a line distal end and a line proximal end, wherein the line distal end is connected to the head piece assembly. The head piece assembly includes an internal post and the tether line includes an eye splice at the line distal end. The eye splice surrounds the internal post.

According to an aspect of the invention, an apparatus includes an EOD disruptor having a barrel. A blank cartridge is loaded in the EOD disruptor. A muzzle-loaded projectile is disposed in front of the blank cartridge. The projectile includes a shaft portion at least partially disposed in the barrel and a head portion disposed outside of the barrel. The head portion includes an internal post and a tether line attached to the internal post.

DESCRIPTION OF THE DRAWINGS

These and other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF EXEMPLARY EMBODIMENTS

Kinetic penetrators may be used for neutralizing unexploded ordnance and improvised explosive devices. A tether may be coupled to the kinetic penetrator to facilitate the recovery of the energetic threat device.

The Below/Above-water Remote Energetic Attachment Kinetic Kill Rod (BREAKKR) projectile relates to a projectile that perforates an energetic threat when fired from an EOD disruptor. The projectile breaks components in the threat object and allows a robust pull line to be secured inside the threat to enable the threat to be pulled or secured. The projectile includes a modular head attached to a rod. The projectile uses a tight-eye connection on the front head of the projectile. The line is protected during impact by running the line parallel to the rod body. The size of the line allows the pull strength to exceed the strength of the structural components of the threat object. In use, the rod is muzzle-loaded into an EOD disruptor, such as a 12-gauge PAN device, with a blank cartridge used to propel the projectile out of the barrel. The projectile perforates the target and the line follows through the perforate hole. Once the entire projectile is inside the target, the projectile turns and does not allow removal from the perforation hole.

Figure 1:
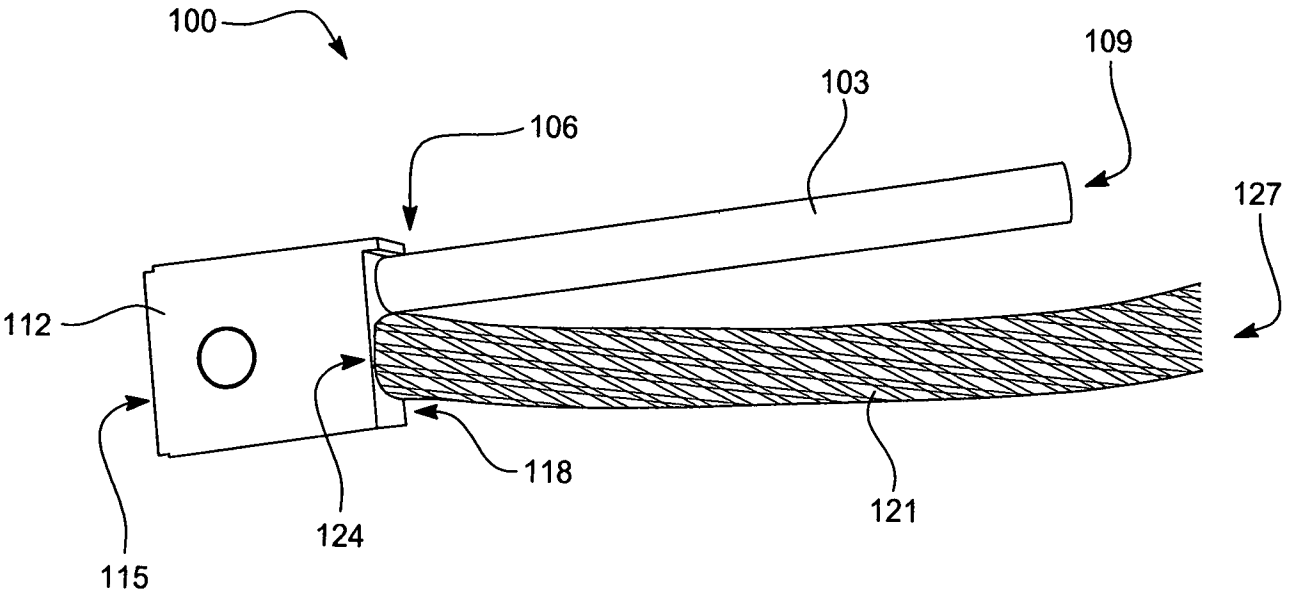
FIG. 1 is a side view of a projectile according to devices herein.

Referring to FIG. 1, a Below/Above-water Remote Energetic Attachment Kinetic Kill Rod (BREAKKR) projectile, indicated generally as 100, includes a shaft 103 having a shaft distal end 106 and a shaft proximal end 109. The BREAKKR projectile 100 also includes a head piece assembly 112 having a head distal end 115 and a head proximal end 118. The shaft distal end 106 is connected to the head proximal end 118. In some exemplary embodiments, the shaft 103 is an elongate rod having a circular cross-section, which is connected to the head piece assembly 112. A tether line 121 is connected to the head piece assembly 112. The tether line 121 has a line distal end 124 and a line proximal end 127. In some embodiments, the tether line 121 may be a robust winch line, such as a Dyneema® winch line that can handle forces exceeding 30,000 lbs. The length of the tether line 121 may be selected dependent upon the intended use/mission and can range from one or more feet to several hundred feet.

Figure 2:
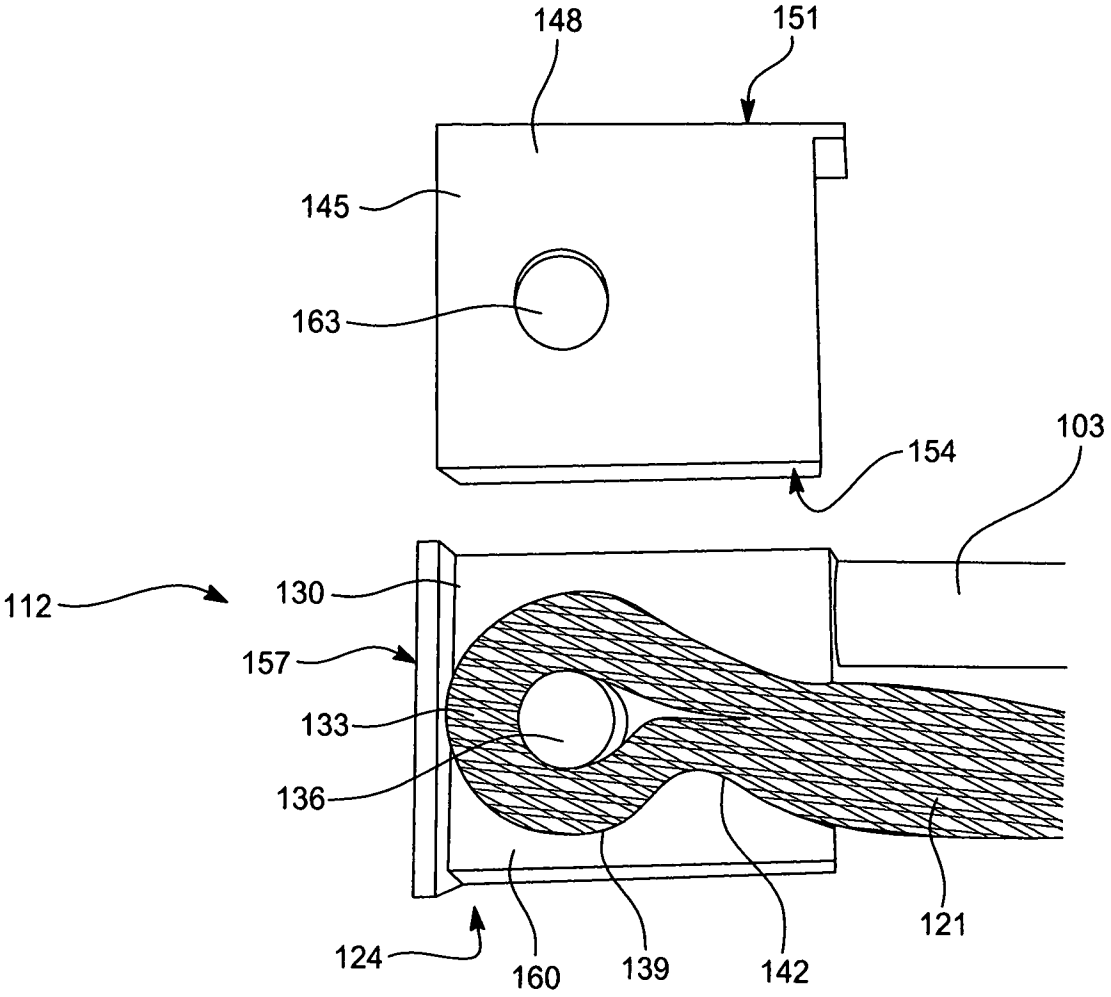
FIG. 2 is a cut-away view of the projectile of FIG. 1.
Figure 3:
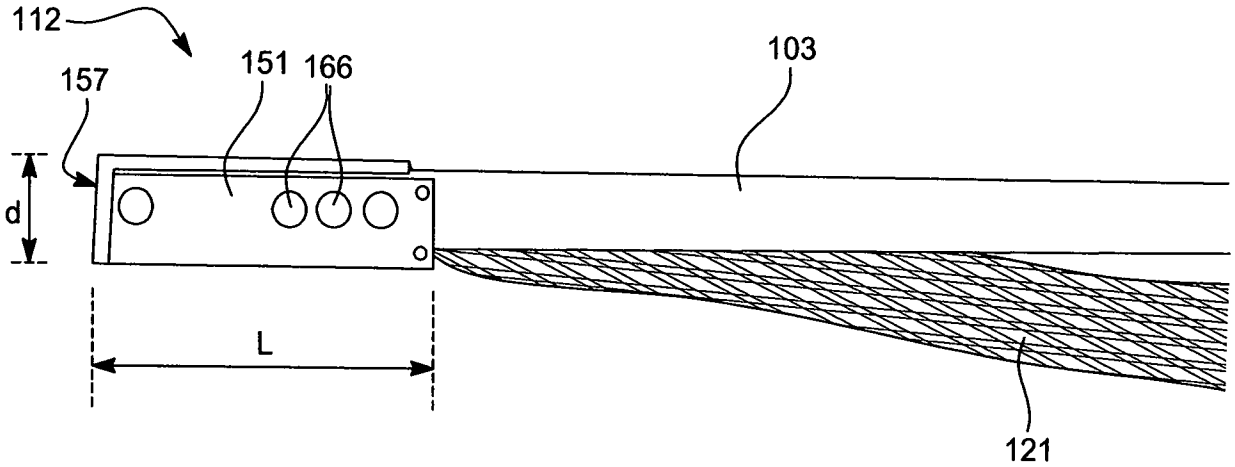
FIG. 3 is a top view of the projectile of FIG. 1.
Figure 4:
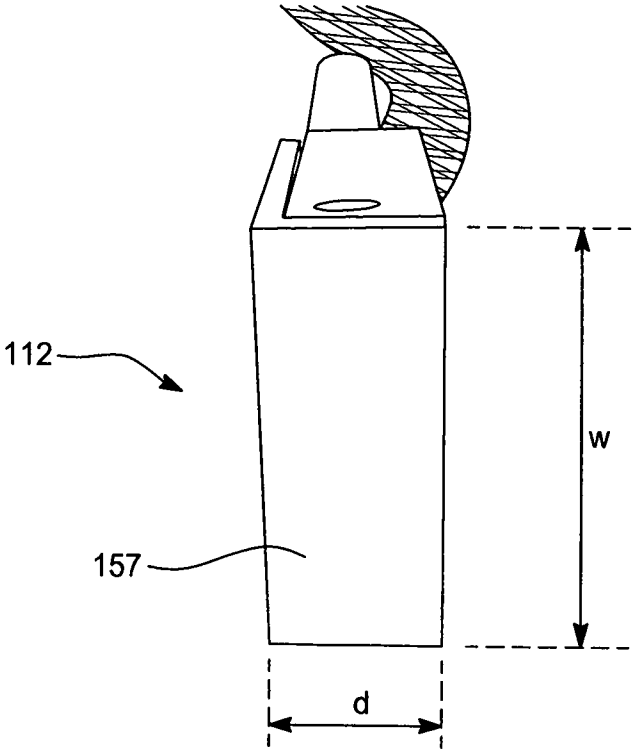
FIG. 4 is an end view of the projectile of FIG. 1.

As shown in FIG. 2, the head piece assembly 112 includes a solid body 130 having a width dimension w, a length dimension L, and a depth dimension d. (The dimensions of the body 130 are best seen in FIGS. 3 and 4.) A substantially circular cavity 133 and an internal post 136 are located within the body 130 of the head piece assembly 112. The tether line 121 has an eye splice 139 at the line distal end 124, which is connected to the head piece assembly 112. The eye splice 139 is attached around the internal post 136, within the circular cavity 133. The head piece assembly 112 also has a channel 142 out of the head proximal end 118 for the tether line 121.

The head piece assembly 112 also includes a cover 145 disposed over the body 130. The cover 145 has a face plate 148 with a top side plate 151 and a bottom side plate 154. The top side plate 151 and bottom side plate 154 are oriented perpendicular to the face plate 148 to wrap at least partially around the body 130. The cover 145 is embedded at least partially into the body 130 at the front face 157 where impact of the BREAKKR projectile 100 will occur. The front face 157 is slightly raised above the surface 160 of the body 130 so it protects the cover 145 from damage upon impact. The face plate 148 has an opening 163 that fits over the internal post 136. When the cover 145 is installed on the body 130, the cover 145 holds the eye splice 139 tight on the internal post 136. Accordingly, the internal post 136 is constrained in the opening 163 so that it can no longer cantilever due to pulling on the tether line 121. The cover 145 is attached to the body by screws or other appropriate fasteners 166, such as shown in FIG. 3. The number and size of such fasteners 166 from the cover 145 to the body 130 determine if the tether line 121 will stay on the internal post 136 during a pull with the tether line 121.

As illustrated in FIGS. 1 and 2, the shaft 103 is connected to the head piece assembly 112 towards the side of the head proximal end 118. This configuration allows the tether line 121 to extend parallel to the shaft 103, which protects the line 121 during impact with a target. The diameter of the shaft 103 is approximately equal to the depth d of the body 130. In an exemplary embodiment, the shaft 103 and the body 130 are integrally formed as a single piece. This structural configuration provides strength at the point that the shaft distal end 106 contacts the head proximal end 118. In some embodiments, the shaft 103 may be attached to the body 130 by a threaded fitting or other appropriate method now known or developed in the future.

Figure 5:
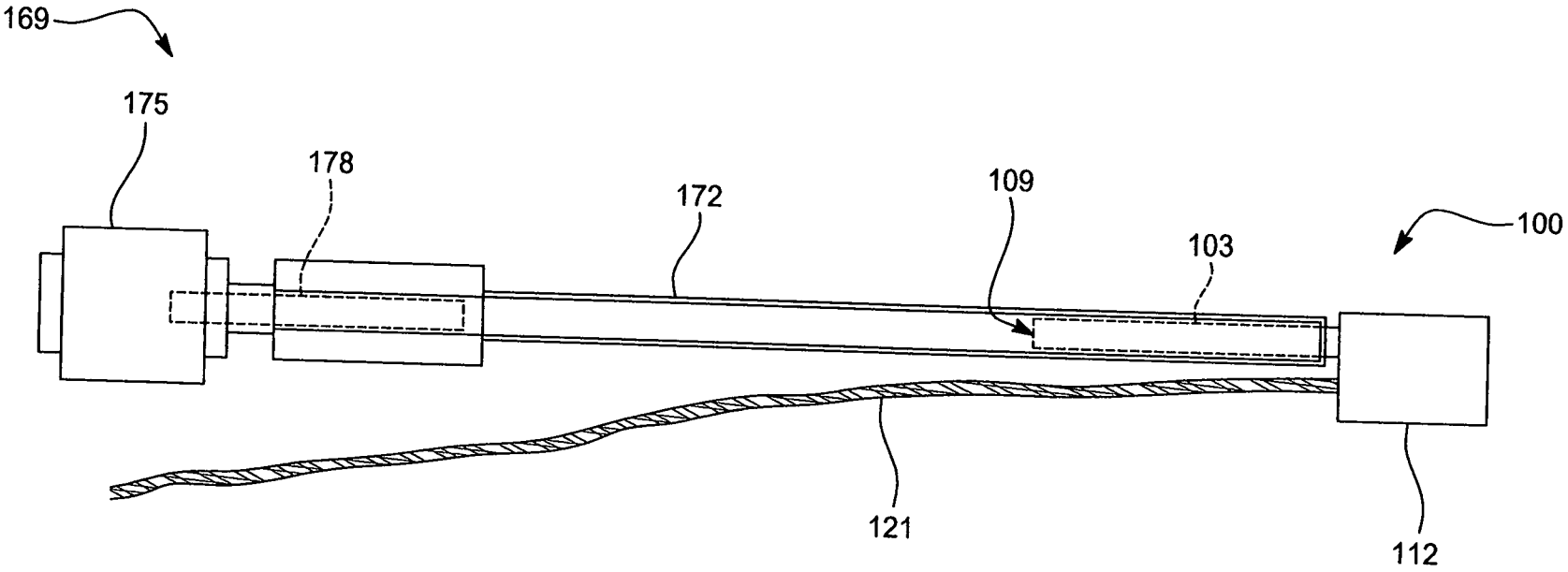
FIG. 5 shows a disruptor according to devices herein.

Referring now to FIG. 5, in one exemplary embodiment, a disruptor 169 is a 12-gauge PAN disruptor having a barrel 172 and a breech 175. The disruptor 169 may be mounted to a known fixed mount stand. A 12-gauge blank cartridge 178 may be loaded in the breech 175 of the disruptor 169. Different types of blank 12-gauge cartridges may be used. For example, there are four conventional blank 12-gauge cartridges of different explosive strengths in common use: enhanced, high velocity, medium velocity and low velocity. This variety of cartridges provides flexibility in projectile velocity and impact pressure. Other specialty blank cartridges with different powder loads and type can be constructed using standard reloading techniques. These blank cartridges can customize the pressure time history of the projectile.

In use, the shaft proximal end 109 is inserted such that at least a portion of the shaft 103 is partially disposed in the barrel 172 and the head piece assembly 112 and tether line 121 are disposed outside of the barrel 172. The shaft 103 is sized and configured with a maximum diameter that is equal to or less than the bore inner diameter of the barrel 172. The shaft 103 may be coated with a non-sparking and friction reducing material, for example, cutting oil. In some exemplary embodiments, the shaft 103 may include a bushing slidably mounted on the shaft 103 or the shaft 103 may be enclosed in a plastic sheath to enable the use of reduced diameter shaft 103 in the barrel 172.

The disruptor 169 may include a water column or wadding disposed in the barrel 172 in front of the blank cartridge 178. The BREAKKR projectile 100 may be disposed in front of the water plug or wadding, if any. The water column has been shown to double the energy output compared to a projectile that has an air gap between the back of the projectile and the blank cartridge. The water creates a hydraulic seal, which decreases propulsion gas blow-by and increases the propulsion gas pressure that drives the projectile forward. A secondary benefit of the water column is a fluid jet that follows the projectile and suppresses thermal effects on the target.

The BREAKKR projectile 100 may be made of, for example, steel, tungsten, metal alloys, and composites. Different portions of the BREAKKR projectile 100 may be made of different materials. The head piece assembly 112 is modular to allow different shaped bodies 130 to be used. In the embodiment shown, the head distal end 115 (i.e., the front portion of the body 130 of the BREAKKR projectile 100) has a flat face 157 that is blunt, which allows impact into curved, round, and/or angled surfaces while the shape of the head piece assembly 112 protects the line during impact. It is contemplated that other shapes may be used for the body 130 of the head piece assembly 112, for example a beveled cutting edge, a forked blade, a blunt, cylindrical end, an ogive shape, a pyramidal shape, or a shape with rows of teeth.

The invention has been described with references to specific exemplary embodiments. While particular values, relationships, materials, and steps have been set forth for purposes of describing concepts of the invention, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present invention, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

The terminology used herein is for the purpose of describing particular systems and methods only and is not intended to be limiting of this disclosure. As used herein, the singular forms "a", "an", and "the" are intended to include the plural forms as well, unless the context clearly indicates otherwise. It will be further understood that the terms "comprises", "comprising", "includes", and/or "including", when used in this specification, specify the presence of stated features, integers, steps, operations, elements, and/or components, but do not preclude the presence or addition of one or more other features, integers, steps, operations, elements, components, and/or groups thereof. Further, the terms "automated" or "automatically" mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various embodiments herein have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

For example, terms such as "right", "left", "vertical", "horizontal", "top", "bottom", "upper", "lower", "under", "below", "underlying", "over", "overlying", "parallel", "perpendicular", etc., as used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A disruptor projectile, comprising:
- a shaft comprising an elongate rod;
- a head piece assembly being connected to an end of the elongate rod;
- an internal post being located inside the head piece assembly; and
- a tether line having a first end comprising an eye splice around the internal post and having a length extending parallel to the elongate rod.

2. The disruptor projectile according to claim 1, wherein the head piece assembly further comprises:
- a solid body;
- a circular cavity located within the solid body;
- a cover; and
- a channel, wherein the tether line being at least partially disposed in the channel, and wherein the internal post is located in the circular cavity.

3. The disruptor projectile according to claim 2, wherein the cover includes an opening that fits over the internal post to hold the eye splice in the solid body, and
- wherein the cover is at least partially embedded in the solid body at a front face of the solid body.

4. The disruptor projectile according to claim 2, wherein the elongated rod is connected to the head piece assembly towards a side of the solid body.

5. The disruptor projectile according to claim 1, wherein the shaft has a circular cross-section and a maximum diameter that is at most equal to a bore inner diameter of a disruptor.

6. The disruptor projectile according to claim 1, wherein the tether line has a pull strength of at least 30,000 lbs.

7. A penetrator projectile for use in a disruptor, comprising:
- a head piece assembly including a head distal end and a head proximal end;
- a shaft including a shaft distal end and a shaft proximal end, wherein the shaft distal end is connected to the head proximal end; and
- a tether line including a line distal end and a line proximal end,
- wherein the line distal end is connected to the head piece assembly,
- wherein the head piece assembly includes an internal post,
- wherein the tether line includes an eye splice at the line distal end, and
- wherein the eye splice surrounds the internal post.

8. The penetrator projectile according to claim 7, wherein the head piece assembly further comprises:
- a solid body;
- a circular cavity located within the solid body;
- a cover disposed over the solid body, and a channel, the tether line being at least partially disposed in the channel, and wherein the internal post is located in the circular cavity.

9. The penetrator projectile according to claim 8, wherein the cover includes an opening that fits over the internal post to hold the eye splice in the solid body, and wherein the cover is at least partially embedded in the solid body at a front face of the solid body.

10. The penetrator projectile according to claim 8, wherein the shaft distal end is connected to the head proximal end towards a side of the solid body.

11. The penetrator projectile according to claim 7, wherein the shaft has a circular cross-section and a maximum diameter that is at most equal to a bore inner diameter of a disruptor.

12. The penetrator projectile according to claim 8, wherein the tether line has a pull strength of at least 30,000 lbs.

13. An apparatus, comprising:

an EOD disruptor having a barrel;

a blank cartridge being loaded in the EOD disruptor; and a muzzle-loaded projectile being disposed in front of the blank cartridge, wherein the muzzle-loaded projectile includes a shaft portion at least partially disposed in the barrel and a head portion disposed outside of the barrel, wherein the head portion includes an internal post, and wherein a tether line is attached to the internal post.

14. The apparatus according to claim 13, wherein the head portion of the muzzle-loaded projectile further comprises:

a solid body;

a circular cavity located within the solid body;

a cover disposed over the solid body; and a channel, the tether line being at least partially disposed in the channel, and wherein the internal post is located in the circular cavity.

15. The apparatus according to claim 14, wherein the cover includes an opening that fits over the internal post to hold the tether line in the solid body, and wherein the cover is at least partially embedded in the solid body at a front face of the solid body.

16. The apparatus according to claim 14, wherein the shaft is connected to the head portion towards a side of the solid body.

17. The apparatus according to claim 14, wherein the solid body includes a width dimension, a length dimension, and a depth dimension, and wherein the depth dimension is equal to a diameter of the shaft portion.

18. The apparatus according to claim 13, wherein the shaft portion has a circular cross-section and a maximum diameter that is at most equal to a bore inner diameter of the barrel.

19. The apparatus according to claim 13, wherein the tether line has a pull strength of at least 30,000 lbs.

20. The apparatus according to claim 13, wherein the tether line further comprises an eye splice at an end of the tether line, and wherein the eye splice is oriented around the internal post.

21. The apparatus according to claim 13, wherein the blank cartridge comprises a 12-gauge cartridge.

* * * * *